US008671705B2

(12) United States Patent
Uchida et al.

(10) Patent No.: US 8,671,705 B2
(45) Date of Patent: Mar. 18, 2014

(54) SHOWCASE

(75) Inventors: Tomohiro Uchida, Gunma (JP); Toshiyuki Tamura, Tochigi (JP); Hirofumi Yanagi, Saitama (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 754 days.

(21) Appl. No.: 11/943,237

(22) Filed: Nov. 20, 2007

(65) Prior Publication Data

US 2008/0115920 A1 May 22, 2008

(30) Foreign Application Priority Data

Nov. 21, 2006 (JP) ..... 2006-314144
Nov. 21, 2006 (JP) ..... 2006-314145

(51) Int. Cl.
*A47F 3/04* (2006.01)
*F28F 1/30* (2006.01)
*F28D 1/04* (2006.01)

(52) U.S. Cl.
USPC ..... 62/246; 165/182; 165/151

(58) Field of Classification Search
USPC ..... 62/515, 272, 246; 165/182, 151
See application file for complete search history.

(56) References Cited

U.S. PATENT DOCUMENTS 3,267,692 A * 8/1966 Pfeiffer et al. ..... 62/515
4,549,605 A * 10/1985 Sacca et al. ..... 165/150
5,117,905 A * 6/1992 Hesse ..... 165/182
5,540,276 A * 7/1996 Adams et al. ..... 165/151
7,028,764 B2 * 4/2006 Reagen ..... 165/150
2003/0159814 A1 8/2003 Sin et al.
2006/0123825 A1 * 6/2006 Duffy ..... 62/246

FOREIGN PATENT DOCUMENTS

JP 63-123964 A 5/1988
JP 64-58995 A 3/1989
JP 2-106570 U 8/1990
JP 04198691 A 7/1992
JP 11-094442 A 4/1999

OTHER PUBLICATIONS

Translation of Examiner's First Report on Australian Patent Application No. 2007237194 mailed Apr. 6, 2009.
Office Action mailed Sep. 14, 2009 in connection with corresponding Canadian Patent Application No. 2,611,252.
Japanese Office Action dated Aug. 30, 2011, issued in corresponding Japanese Patent Application No. 2006-314145.

* cited by examiner

*Primary Examiner* — Cassey D Bauer
(74) *Attorney, Agent, or Firm* — Westerman, Hattori, Daniels & Adrian, LLP

(57) ABSTRACT

A showcase having a fin-and-tube type cooler includes planar fins and a refrigerant pipe penetrating through the planar fins. The planar fins include long fins arranged in parallel to an air flow direction through the cooler, and short fins shorter in length than the long fins and arranged between adjacent long fins at a downstream side of the cooler. The refrigerant pipe includes first U-shaped hair pins having two straight pipe portions, and second U-shaped hair pins having two straight pipe portions. The pitch between the two straight pipe portions of each second U-shaped hair pin is set to double the pitch between the two straight pipe portions of each first U-shaped hair pin. The first and second U-shaped hair pins penetrate through the hole portions formed in the plural planar fins so as to be arranged in a predetermined style.

3 Claims, 8 Drawing Sheets

SHOWCASE

CLAIM OF PRIORITY

The present application claims priority under 35 U.S.C. §119 to Japanese Patent Application Nos. 2006-314144 and 2006-314145 filed on Nov. 21, 2006.

BACKGROUND OF THE INVENTION

1. Field of the Invention

The present invention relates to a showcase for storing foods, etc. under the state that the foods, etc. are kept fresh for a long term to sell the foods, etc. in a store.

2. Description of the Related Art

In a supermarket or a convenience store is placed a showcase which is opened at the front side thereof so that purchasers can easily pick up foods, etc. to be sold (for example, dressed meat, fresh fish, frozen foods, ice cream, etc.). A cooler is provided in such a showcase, and there is known a so-called fin-and-tube type cooler in which plural fins are arranged in alignment with one another so as to be spaced from one another at predetermined intervals, and refrigerant pipes (for example, so-called hair pins or the like may be used) penetrate through through-holes formed in the plural fins. In the cooler, air in the neighborhood of the fins is cooled by the endothermic action of refrigerant flowing in the refrigerant pipes formed by the hair pins, and the cooled air is fed into a storage room in which foods, etc. are displayed, whereby the foods, etc. can be frozen or cooled (for example, see JP-A-11-94442).

In the case of an open showcase which is opened at the front side thereof as described above, outside air freely enters the storage room. Therefore, water components contained in the outside air are cooled by the fins, so that the fins are frosted in some cases. Particularly when the gap between the neighboring fins is small, the gap portion is supercooled and thus the fins are liable to be frosted. In order to prevent the fins from being frosted, the gap between the neighboring fins is kept to a predetermined length or more. These gaps can be secured as follows. That is, the edge portions of the through-holes of the fins are projected by the burring method so that the projecting portions 36 have a predetermined length or more, and the fins are assembled while the projecting portions abut against the adjacent fins, whereby the gaps can be secured.

Furthermore, $CO_2$ refrigerant is used as one of a series of countermeasures to global environment and global warming problems. $CO_2$ refrigerant is used while pressurized till pressure in the neighborhood of the critical point, and the pressure loss is little. Therefore, a refrigerant circuit can be constructed by using a refrigerant pipe narrower (smaller in pipe diameter) than a conventional refrigerant pipe (conversely, a refrigerant pipe having a large diameter needs a larger refrigerant amount and thus the efficiency is lowered).

However, when the refrigerant pipe for $CO_2$ is narrowed, the diameter of the through-holes of the fins is also reduced. Therefore, it is difficult to set the projection length of the projecting portions formed by the burring method to a predetermined length or more. Therefore, in the assembling work of the cooler for $CO_2$ refrigerant, the projecting portions are not used, but a jig for keeping the predetermined length between the fins is separately used.

Furthermore, the hair pin is constructed by bending a refrigerant pipe in an U-shape, and has straight pipe portions which extend in parallel to each other so as to be spaced from each other at a predetermined interval (pitch), and the straight pipe portions penetrate through the plural fins. Plural hole portions are formed in the plural fins, and the straight portions of the hair pins are inserted through the hole portions. For example, there is know a cooler in which plural holes are arranged on three columns along the flow direction of air to be cooled although the number of the columns is varied in accordance with the size, shape, etc. of the cooler. Furthermore, the pitch of the adjacent hole portions is equal to the same dimension of the pitch of the straight pipe portions.

As described above, in the case of the open showcase which is opened at the front side thereof, outside air freely enters the storage room, and the water components contained in the outside air are brought into the fins or the hair pins and cooled, so that the fins or the hair pins are frosted in some cases. Particularly when the straight portions of the plural hair pins are locally densely arranged, the gap between these portions is small and thus air passing through the gap portions is supercooled, and thus the fins and the hair pins are liable to be frosted.

As described above, in order to arrange the hair pins so that the straight portions of the hair pins are not locally dense, it is preferable that the hair pins are not secured so as to be arranged on the same line, but secured so as to be suspended between adjacent columns out of the three columns on which the plural hole portions are arranged. However, when the hair pins are secured to the hole portions of the three columns, with respect to only one line, it is difficult to suspend the hair pins between this line and another adjacent line, and the hair pins must be arranged on only this one line. Therefore, the straight portions are densely arranged in the neighborhood of the hair pins arranged on the same line. Accordingly, the flow of air to be cooled may be disturbed by frost occurring at these portions.

SUMMARY OF THE INVENTION

The present invention has been implemented in view of the foregoing situation, and has an object to provide a showcase having a cooler whose fins can be assembled so as to keep the interval between the adjacent fins without using any special jig.

Another object of the present invention is to provide a showcase having a cooler in which refrigerant pipes can be prevented from being locally and densely arranged even when the number of columns of hole portions formed in fins through which the refrigerant pipes penetrate is equal to three.

In order to attain the above objects, according to a first aspect of the present invention, in a showcase having a fin-and-tube type cooler which comprises plural planar fins and a refrigerant pipe penetrating through the plural planar fins and cools air to be fed toward display racks, the plural planar fins comprise long fins arranged in parallel to an air flow direction along which air flows through the cooler, and short fins that are shorter in length in the air flowing direction than the long fins and arranged between respective adjacent long fins at the downstream side of the cooler with respect to the air flowing direction.

In the above showcase, the long and short fins are provided with hole portions through which the refrigerant pipe penetrates, and projecting portions are formed at the edge portions of the hole portions, and the long and short fins are assembled so that the projecting portions thereof abut against the adjacent fins, thereby keeping the interval between the respective adjacent fins.

In the above showcase, the projecting portions are formed by subjecting the hole portions to burring processing.

In the above showcase, the fin pitch of the fins at the upstream side of the cooler with respect to the air flow direction is set to the double pitch of the fin pitch of the fins at the downstream side of the cooler with respect to the air flow direction.

According to a second aspect of the present invention, in a showcase having a fin-and-tube type cooler which comprises plural planar fins and a refrigerant pipe penetrating through the plural planar fins and cools air to be fed toward display racks, the plural planar fins being provided with hole portions through which the refrigerant pipe penetrates, the refrigerant pipe comprises first U-shaped hair pins each having two straight pipe portions and second U-shaped hair pins each having two straight pipe portions, the pitch between the two straight pipe portions of each second U-shaped hair pin is set to the double of the pitch between the two straight pipe portions of each first U-shaped hair pin, and the first and second U-shaped hair pins penetrate through the hole portions formed in the plural planar fins so as to be disposed in a predetermined arrangement style.

In the above showcase, the plural holes are aligned on three columns along a flow direction of air to be cooled so that any selected three adjacent hole portions constitute the apexes of a substantially regular triangle, the first U-shaped hair pins are arranged so as to bridge the hole portions of the adjacent two columns so that the pitch between the two straight pipe portions of each first U-shaped hair pin is equal to the length of one side of the substantially regular triangle, and the second U-shaped hair pins are arranged so as to bridge the hole portions of the two columns at both the ends of the cooler excluding the center column out of the three columns.

In the above showcase, the plural hole portions are arranged on plural lines which intersect to the flow direction of the air to be cooled at an angle of about 60°, and the respective straight pipe portions of the U-shaped first and second hair pins are interspersed every other line when viewed from the direction intersecting to the flow direction of the air to be cooled.

According to the present invention, the plural fins of the cooler are constructed by the long fins and the short fins which are different in length in the air flow direction, the projecting portions are formed at the edge portions of the hole portions through which the refrigerant pipe is inserted, and the short fins are arranged between the long fins at the downstream side with respect to the air flow direction so that the projecting portion of each short fin abuts against the adjacent long or short fin to thereby form the gaps between the plural fins. Therefore, the interval between the long fins located at the upstream side with respect to the air flow direction can be settled to one value on the basis of the length of the projecting portions of the short fins located at the downstream side with respect to the air flow direction. Therefore, by assembling the fins while the projecting portions of the short fins located at the downstream side abut against the adjacent fins, the interval between the long fins located at the upstream side can be kept to a predetermined interval without using any special jig for keeping the interval between the long fins. Accordingly, the number of steps of the fabrication process can be reduced.

Furthermore, the projecting portions can be formed by the burring processing of the hole portions, and thus the projecting portions can be easily formed in the process of forming the hole portions. Still furthermore, a narrow refrigerant pipe through which $CO_2$ refrigerant flows is used in the cooler and thus the diameter of the hole portions can be reduced. Accordingly, even when a sufficient projection length of the projecting portions cannot be secured by the burring processing, a large interval can be secured between the long fins located at the upstream side.

Still furthermore, according to the present invention, the straight pipe portions of each of the first hair pins and the second hair pins can be arranged so as to bridge different columns at all times. Therefore, as compared with the case where the hair pins (the straight pipe portions of each hair pin) are arranged on the same column, the straight pipe portions can be prevented from being locally and densely arranged. As a result, the cooler is hardly frosted, and thus there can be provided a showcase in which flow of air to be cooled can be prevented from being disturbed by frost and also stable cooling performance can be performed.

DETAILED DESCRIPTION OF THE PREFERRED EMBODIMENTS

Preferred embodiments according to the present invention will be described hereunder with reference to the accompanying drawings.

A showcase according to an embodiment of the present invention will be described.

Figure 1:
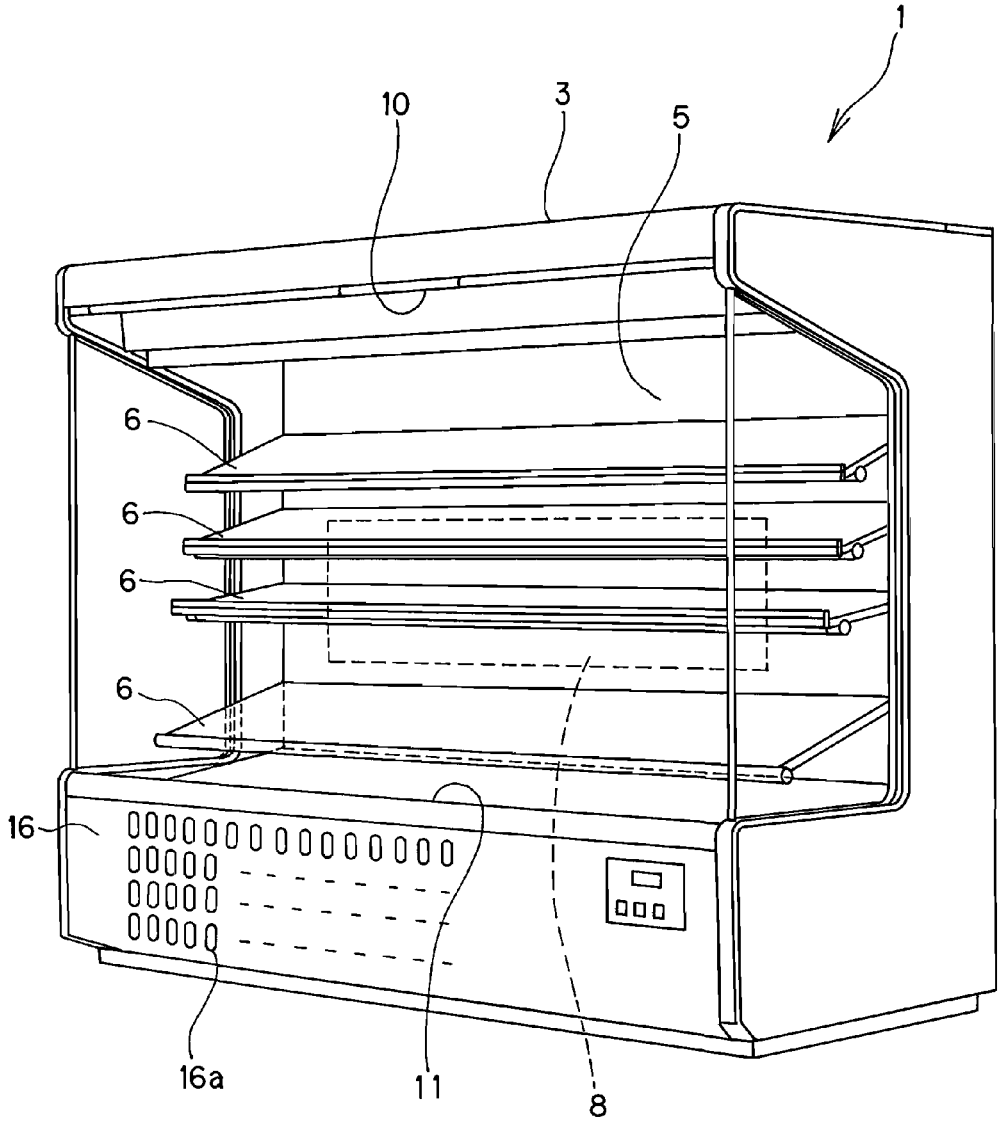
FIG. 1 is a perspective view showing a showcase according to the present invention when the showcase is viewed from the obliquely right side in front of the showcase.
Figure 2:
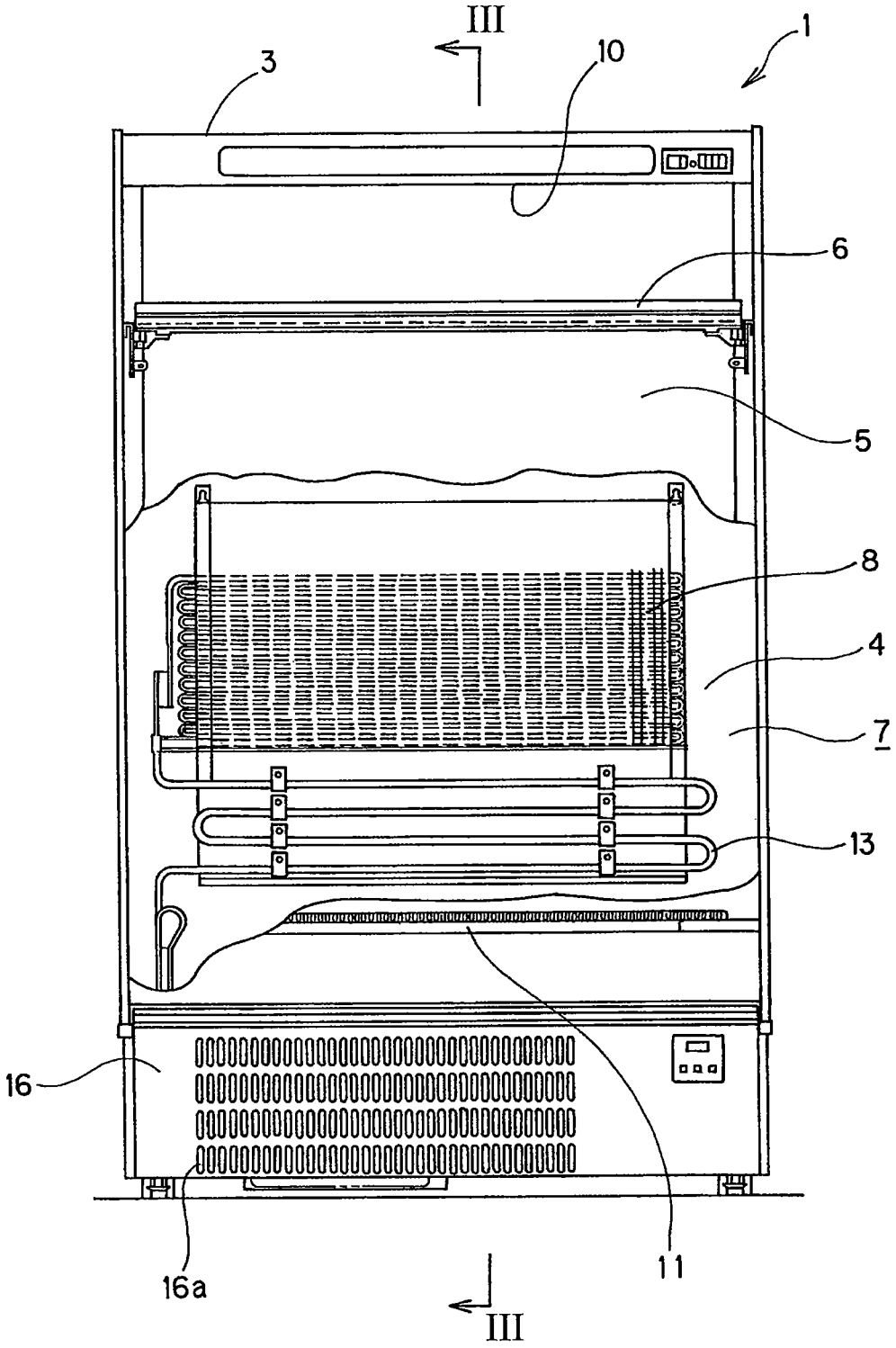
FIG. 2 is a front view showing the showcase according to the present invention while the inner wall portion thereof is partially cut out.
Figure 3:
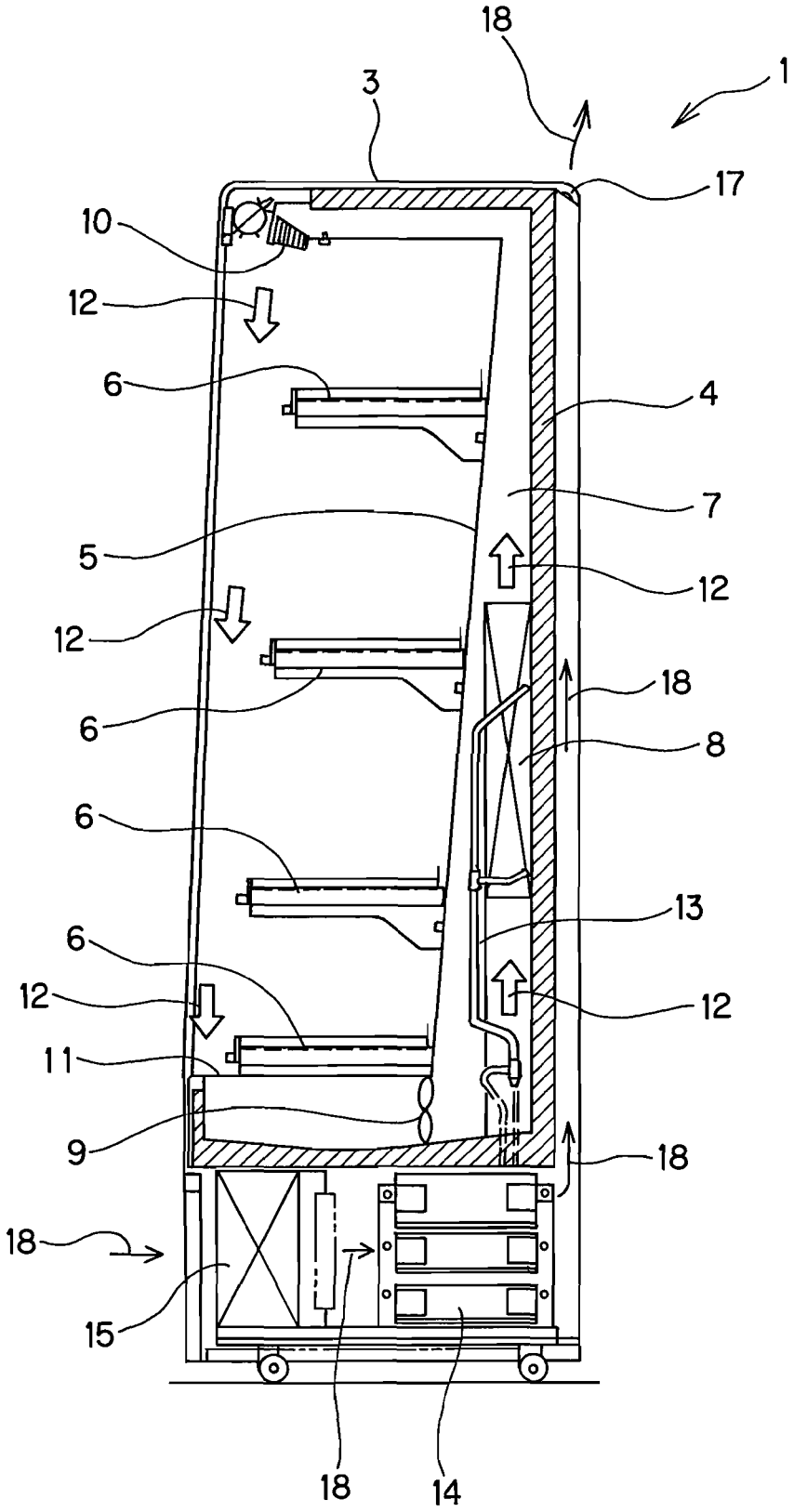
FIG. 3 is a side cross-sectional view which is taken along line III-III of FIG. 2.

FIG. 1 is a perspective view when the showcase of the embodiment is viewed from the oblique right side in front of the showcase. FIG. 2 is a front view of the showcase and the inner wall portion is partially cut out. FIG. 3 is a side cross-sectional view which is taken along A-A line of FIG. 2. The directions used in the following description of the embodiments are defined with respect to FIG. 2 so that the up and down directions on the sheet surface are set to the up and down directions of the showcase, the right and left directions on the paper surface are set to the right and left directions of the showcase and the depth direction on the paper surface is set to the forward and rearward directions of the showcase.

The showcase 1 according to this embodiment is of a multi-stage open type as shown in FIG. 1. This showcase 1 has a showcase main body 3 constituting the outside body, a substantially U-shaped adiabatic wall portion 4 provided in the showcase main body 3, an inner wall portion 5 provided in the U-shaped inside portion of the adiabatic wall portion 4, and four display racks 6 secured to the inner wall portion 5 as shown in FIGS. 1 to 3 (particularly FIG. 3).

As shown in FIG. 3, a duct 7 through which cold air is made to flow is formed between the adiabatic wall portion 4 and the inner wall portion 5, and a cooler 8 (evaporator) for cooling air and an air blower 9 which is disposed at the lower side of the cooler 8 and blow air (cold air) upwardly to the cooler 8 are disposed in the duct 7.

Furthermore, as shown in FIG. 3, a cold air blow-out port 10 which is connected to the upper end portion of the duct 7 is formed at the upper portion of the showcase 1, and a cold air suction port 11 which is connected to the lower end portion of the duct 7 is formed at the lower portion of the duct 7. Accordingly, air which is blown by the air blower 9 is cooled by the cooler 8, and then the cold air is made to flow upwardly and discharged to from the cold air blow-out port 11 toward the display racks 6. The cold air in the neighborhood of the display racks 6 is sucked from the air suction port 11 into the duct 7, and made to flow to the cooler 8 by the air blower 9 again. This air circulating flow is indicated by an arrow 12 of FIG. 3.

As shown in FIG. 3, a compressor 14, a heat exchanger 15, etc. which are connected to the cooler 8 through the refrigerant pipe 13 are disposed at the lower side of the adiabatic wall portion 4 of the lower portion of the showcase 1, and these elements constitute a refrigerant circuit. The heat exchanger 15 is cooled by the outside air taken in through air suction holes 16*a* of the front panel 16 shown in FIGS. 1 and 2. The heat-exchanged air is passed through the gap between the showcase main body 3 and the adiabatic wall portion 4 and discharged from an upper discharge port 17 to the outside as shown in FIG. 3. The flow of the outside air is indicated by an arrow 18 of FIG. 3. $CO_2$ refrigerant is used as refrigerant in the refrigerant circuit constructed by the cooler 8, the compressor 14, the heat exchanger 15, etc. according to this embodiment. The refrigerant pipe 13 through which the $CO_2$ refrigerant flows is set to be smaller in pipe diameter than a refrigerant pipe used in a circuit using normal refrigerant (for example, $CCl_2F_2$ or the like). The refrigerant circuit of this embodiment is the same as the conventional refrigerant circuit, and thus the description thereof is omitted.

Figure 4:
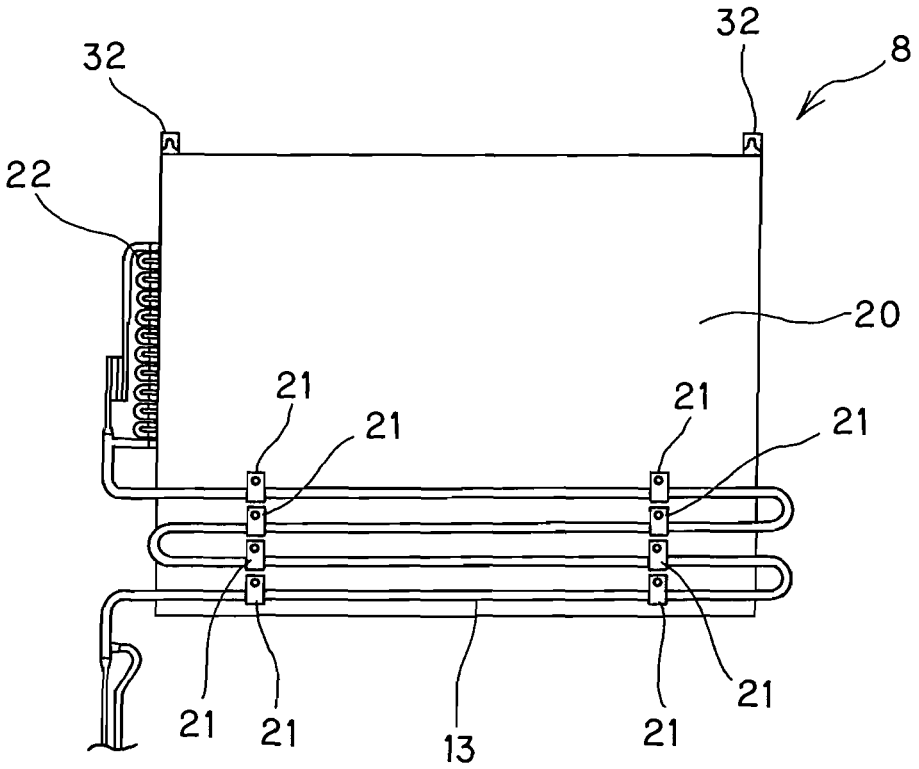
FIG. 4 is a front view showing a cooler used in a showcase as a simple body.

FIG. 4 is a front view showing the cooler 8 as a single body. A cover 20 is secured to the front face of the cooler 8. At the lower portion of the cover 20, the refrigerant pipe 13 is drawn from the lower side so as to meander in the right-and-left direction, and the drawn refrigerant pipe 13 is fixed to the cover 20 by fixing clasps 21. Furthermore, the refrigerant pipe 13 is connected to a cooling portion 22 covered by the cover 20.

Figure 5:
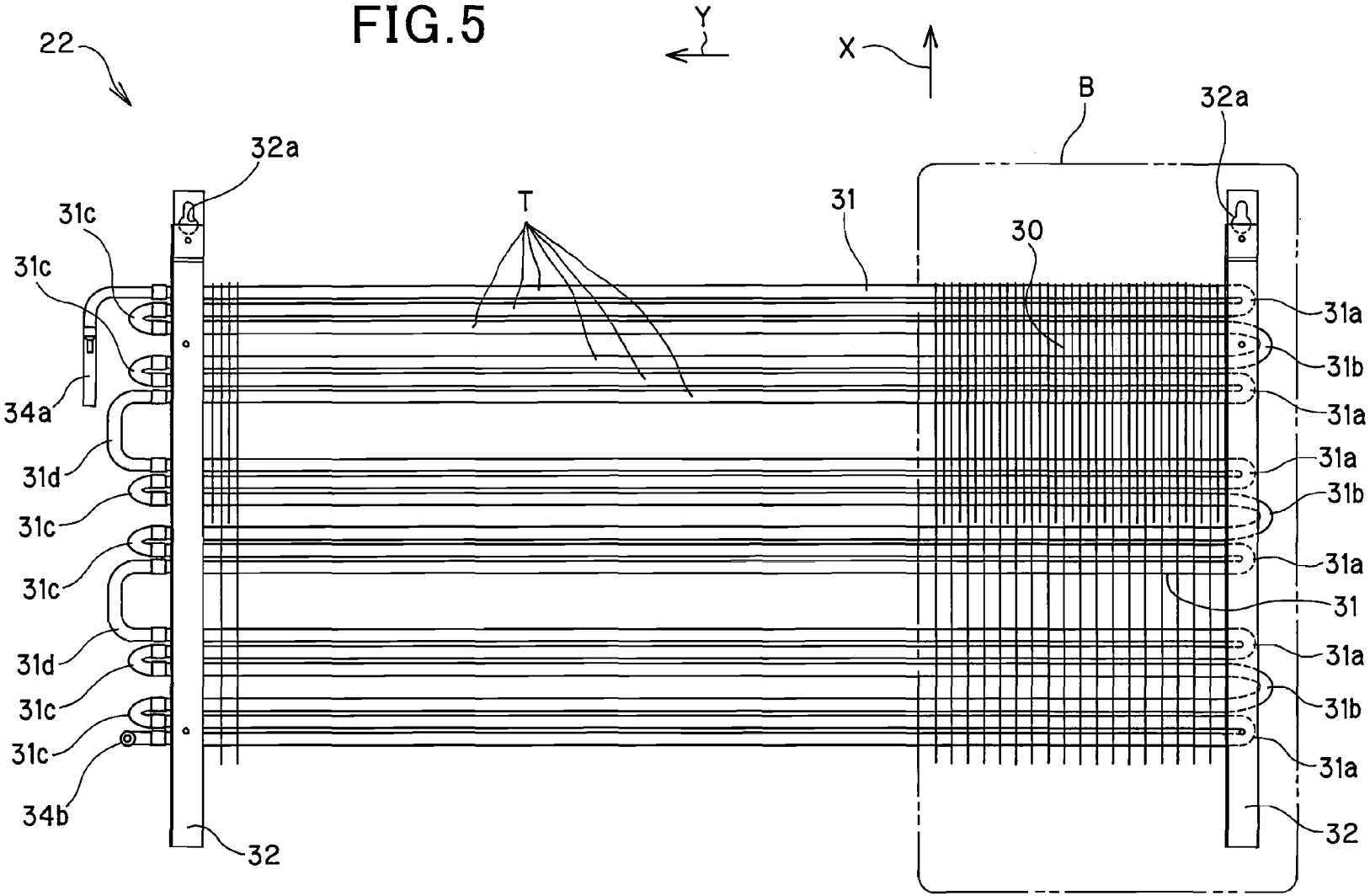
FIG. 5 is an enlarged front view of a cooling portion according to an embodiment of the present invention under the state that a front cover of the cooler of FIG. 4 is detached.
Figure 6:
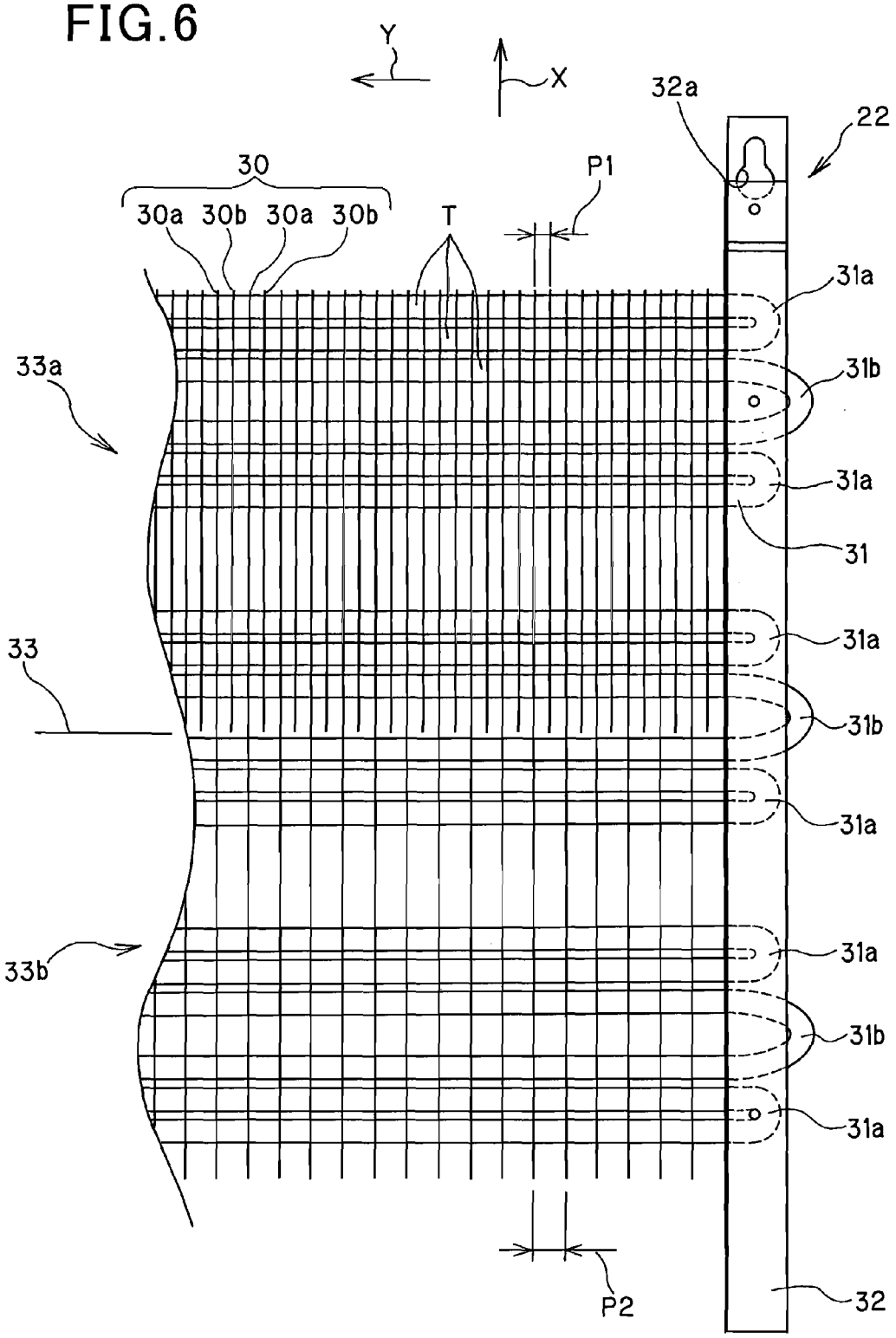
FIG. 6 is an enlarged view of a B portion shown in FIG. 5.

FIG. 5 is an enlarged front view showing the cooling portion 22 under the state that the front cover is detached from the cooler 8 of FIG. 4. FIG. 6 is an enlarged view of a B portion of FIG. 5.

The cooling portion 22 is equipped with plural fins 30, a refrigerant pipe 31 penetrating through the plural fins 30, and side metal fittings 32 constituting both the side portions of the cooling portion 22, thereby constructing a so-called fin and tube type heat exchanger.

As shown in FIG. 5, the refrigerant pipe 31 comprises plural long U-shaped pipes (first hair pins 31*a*, second hair pins 31*b*) and plural short U-shaped pipes 31*c*, 31*d* which are connected to one another by welding, thereby forming a flow passage of $CO_2$ refrigerant. The second hair pins 31*b* are designed so that the interval (pitch) between the straight portions T thereof is set to be larger than the interval (pitch) between the straight portions T of the first hairpins 31*a*, and preferably the interval of the straight portions T of the second hair pins 31*b* is set to the double of the interval between the straight portions T of the first hair pins 31*a*). By using the first hair pins 31*a* and the second hair pins 31*b*, the refrigerant pipe 31 can be designed so as to penetrate through the plural fins 30 while repetitively meandering in the right-and-left (Y) direction as shown in FIG. 5. The refrigerant pipe 31 is connected to the refrigerant pipe 13 at a flow-in connection port 34*a* so that $CO_2$ flows into the refrigerant pipe 31. Furthermore, $CO_2$ refrigerant passing through the refrigerant pipe 31 flows out from a refrigerant pipe (not shown) connected to a flow-out connection port 34*b*. The pipe diameter of the refrigerant pipe 31 is set to the same as the refrigerant pipe 13, and it is set to a smaller value than the pipe diameter of a refrigerant pipe used in a circuit using general refrigerant (for example, $CCl_2F_2$ or the like).

Each of the plural fins 30 is designed to have a planar shape, and two types of fins, that is, long fins 30*a* and short fins 30*b* are used as shown in FIG. 6. The long fins 30*a* are designed to be larger in length than the short fins 30*b* in the up-and-down (X) direction through which air is cooled (preferably set to about the double of the length of each short fin 30*b*). The long fins 30*a* and the short fins 30*b* are arranged substantially in parallel along the up-and-down (X) direction, and also they are alternately arranged in the right-and-left (Y) direction so as to be spaced from one another. That is, each short fin 30*b* is located to be adjacent to each long fin 30*a*, and each long fin 30*a* is located to be adjacent each short fin 30*b*.

Furthermore, the long fins 30*a* and the short fins 30*b* are arranged so that the upper ends thereof are aligned with one another. That is, at the upper portion 33*a* of the cooling portion 22 (which is higher than the center line 33 in the up-and-down direction and a downstream side portion with respect to the air flow direction), the long fins 30*a* and the short fins 30*b* are alternately arranged at the downstream side portion with respect to the air flow direction, and thus the fin pitch P1 is small. On the other hand, at the lower portion 33*b* of the cooling portion 22 ((which is lower than the center line 33 shown in FIG. 6 and an upstream side portion with respect to the air flow direction), only the long fins 30*a* are arranged, and thus the fin pitch P2 is larger than the fin pitch P1 (for example, P2=2×P1).

The long fins 30*a* and the short fins 30*b* are arranged all over at the fin pitch P between the side metal fittings 32, and some fins 30 are omitted from the illustration of FIG. 5.

Figure 7:
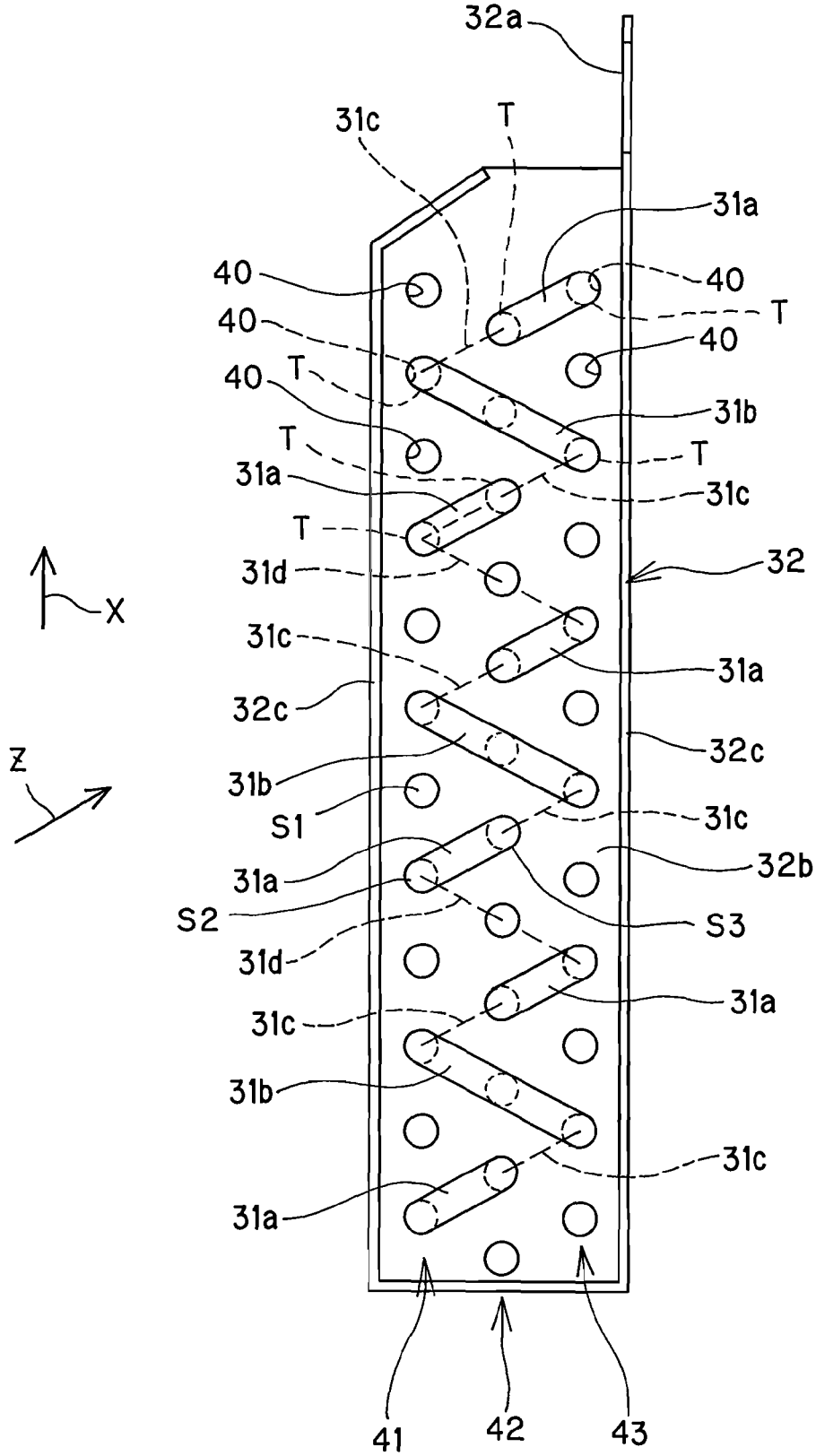
FIG. 7 is a left side view of the cooling portion shown in FIG. 5.

FIG. 7 is a left side view of the cooling portion 22 shown in FIG. 5.

Each side metal fitting 32 is equipped with a U-shaped pipe fixing face portion 32*b* and a side face portion 32*c* upstanding from the edge portion of the U-shaped pipe fixing face portion 32*b* to the outside of the cooling portion 22. Plural hole portions 40 through which the first hair pins 31*a* and the second hair pins 31*b* are inserted are formed in the U-shaped pipe fixing face portion 32*b*. These plural hole portions 40 are arranged on three columns in the up-and-down (X) direction (a left column 41, a center column 42 and a right column 43), and the inserted first hair pins 31*a* and second hair pins 31*b* are fixed to the U-shaped pipe fixing face portions 32*c* by welding. These plural hole portions 40 are arranged so that any selected adjacent hole portions (for example, represented by characters S1, S2, S3 in FIG. 7) constitute the apexes of a substantially regular triangle, and the hole pitch between the respective adjacent hole portions 40 is fixed. This hole pitch is coincident with the interval (pitch) T of the U-shaped straight pipe portions of each first hairpin 31*a*, and the double pitch of this hole pitch is coincident with the interval (pitch) of the U-shaped straight pipe portions of each second hair pin 31*b*.

Figure 8A:
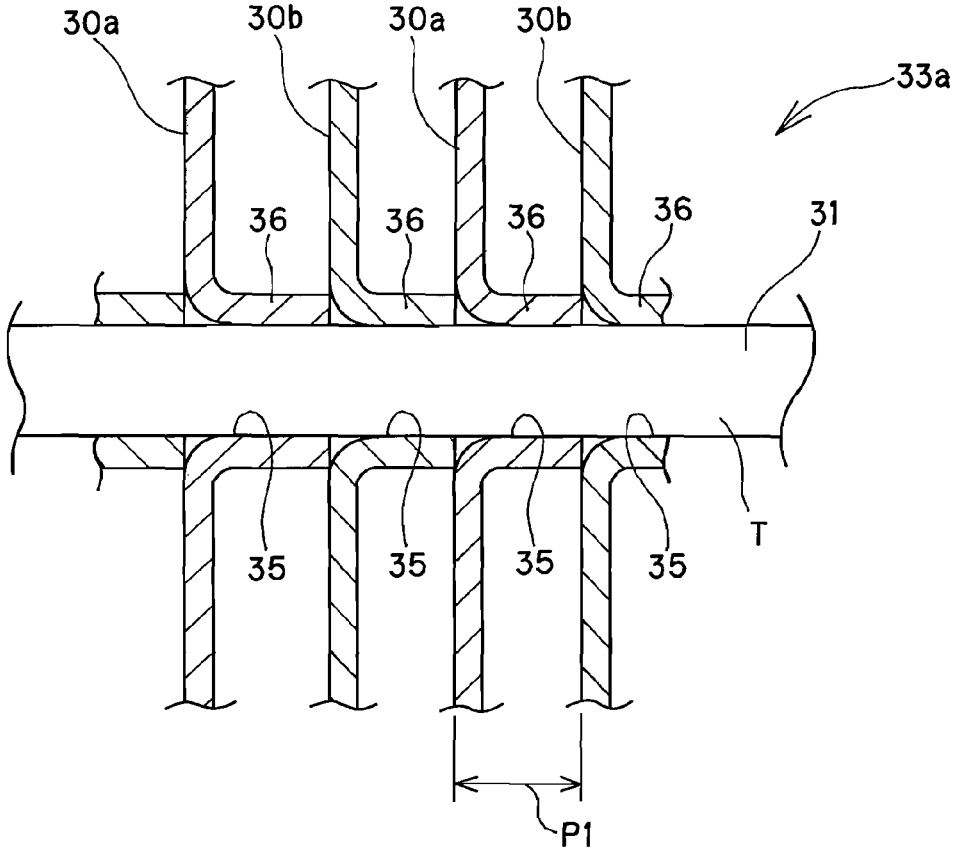
FIGS. 8A and 8B are diagrams showing the fixing of a refrigerant pipe 31, long fins 30*a* and short fins 30*b* at the upper side and at the lower side, respectively.
Figure 8B:
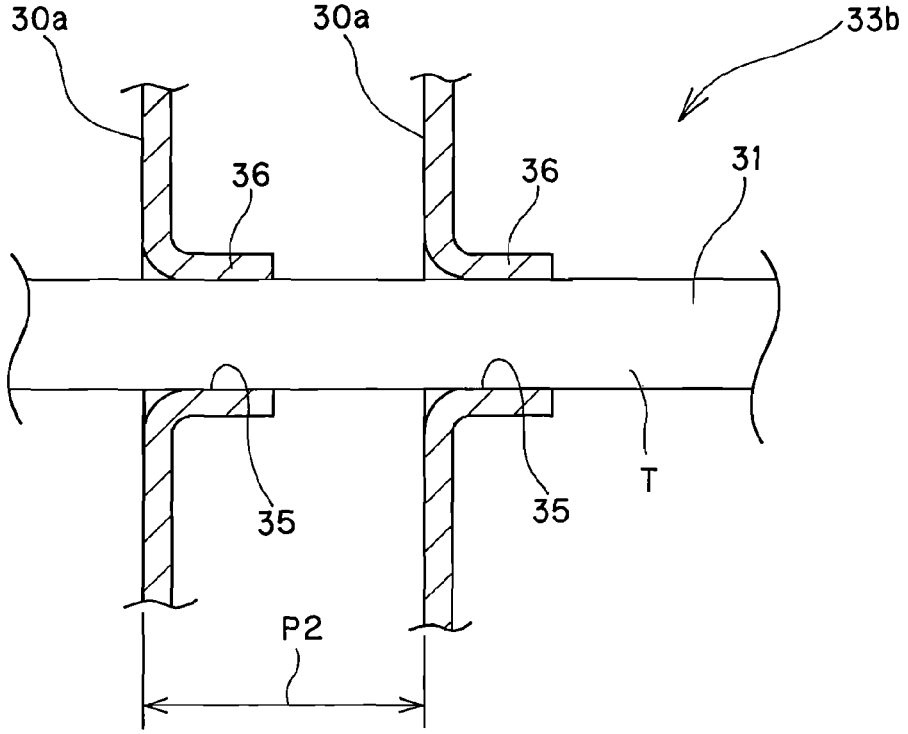

The long fins 30*a* and the short fins 30*b* have substantially the same shape as the side metal fittings 32, and plural hole portions 35 (the details thereof are shown in FIGS. 8A and 8B) are formed at the positions corresponding to the hole portions 40 of the side metal fittings 32 in the long and short fins 30*a* and 30*b*. The first and second hair pins 31*a* and 31*b* are inserted through these hole portions 35.

As shown in FIG. 7, the first hair pins 31*a* are secured so as to bridge the adjacent columns (for example, the columns 41 and 42 or the columns 42 and 43), and not secured on the same column as shown in FIG. 7. Furthermore, the second hair pins 31*b* are secured so as to bridge the columns 41 and 43 at both the ends (that is, both the end columns 41 and 43) except for the center column 42 of the three columns. That is, the first and second hair pins 31*a* and 31*b* are inserted in the hole portions 40 obliquely (at an angle of about 60°) with respect to the flow direction of air to be cooled (in the up-and-down (X) direction).

Furthermore, in this embodiment, when viewed along the Z direction (the direction intersecting to the air flow direction at about 60°), the plural hole portions 40 constitute plural lines (i.e., are arranged on plural lines) along the Z direction as shown in FIG. 7, and under the state that the first and second hair pins 31*a* and 31*b* are secured, the respective straight pipe portions T of the first and second hair pins 31*a* and 31*b* are interspersed every other line.

The portions represented by dashed lines in FIG. 7 correspond to the short U-shaped pipes 31C and 31*d* secured to the side metal fitting 32 at the opposite side by welding, and the short U-shaped pipes 31*c* and 31*d* connect the adjacent end portions of the first and second hair pines 31*a* and 31*b*. Accordingly, as shown in FIG. 7, the refrigerant pipe 31 extends in the zigzag form to form one refrigerant pipe passage in side view.

Furthermore, as shown in FIG. 5, a key-hole type (like gourd shape) securing hole 32*a* is formed at the upper portion of each side metal fitting 32, and a fastening member is inserted into the securing hole 32*a* so that the cooler 22 is secured to the showcase main body side.

FIGS. 8A and 8B are diagrams showing the fixing state of the refrigerant pipe 31 and the long and short fins 30*a* and 30*b*.

Hole portions 35 which are subjected to burring processing (method) are formed at portions of the long and short fins 30*a* and 30*b* through which the refrigerant pipe 31 should be inserted, and projecting portions 36 are formed by the burring method. As shown in FIG. 8A, the projecting length of each projecting portion 36 is set to be equal to the fin pitch P1, and these fins 30*a* and 30*b* are assembled so that each fin abuts against the adjacent fin at the upper portion 33*a*. Accordingly, at the upper portion 33*a*, the fins are assembled so that the gap between the long fin 30*a* and the short fin 30*b* is not smaller than the fin pitch P1. Furthermore, the refrigerant pipe 31 is pushed and inserted into the hole portions 35, and the refrigerant pipe 31 and the fins 30 are assembled by so-called clamp and fitting. In this case, the projecting portions 36 are preferably formed so as to extend in the arrangement direction of the fins (i.e., the penetrating direction of the refrigerant pipe).

On the other hand, as the lower portion 33*b*, as shown in FIG. 8B, no short fin 30*b* exists between the adjacent long fins 30*a*, and thus each projecting portion 36 does not abut against the adjacent fin. However, the fins 30 are assembled while the fin pitch P1 is secured at the upper portion 33*a*, and thus the fin pitch P2 of the adjacent long fins 30*a* is necessarily secured.

In the above construction, the fin pitch P2 is set to be longer than the length at which frost is liable to occur between the fins (this value varies in accordance with the cooling capability of the cooler), so that the fins are hardly frosted. Furthermore, on the basis of the diameter of the hole portions 35 and the plate thickness of the fins which are set in connection with the narrow refrigerant pipe for use of $CO_2$ refrigerant, the fin pitch P2 is set to be longer than the maximum length of the projecting portions 36 which can be formed by the burring method.

On the other hand, the fin pitch P1 is set to be shorter than the length at which the fins are hardly frosted, and on the basis of the diameter of the hole portions 35 and the plate thickness of the fins which are set in connection with the narrow refrigerant pipe for use of $CO_2$ refrigerant, the fin pitch P1 is set to be less than the maximum length of the projecting portions 36 which can be formed by the burring method.

According to the showcase of the first construction of the embodiment of the present invention, the fins 30 are constructed by the long fins 30*a* and the short fins 30*b* which are different in length in the up-and-down direction (the air flowing direction). The long fins 30*a* and the short fins 30*b* are alternately arranged at the upper portion 33*a* (at the downstream side portion with respect to the air flowing direction), and only the long fins 30*a* are arranged at the upper portion 33*a* (at the upstream side portion with respect to the air flowing direction). The pitch P2 between the long fins 30*a* at the lower portion 33*b* is set to such a value that the fins 30*a* are hardly frosted. Therefore, the upstream side portion of the cooler 32 which may be easily frosted because air is first cooled at the upstream side portion can be prevented from being frosted.

Furthermore, the projecting portions 36 having the length corresponding to the fin pitch P1 are formed at the edge portions of the hole portions 35 of the long and short fins 30*a* and 30*b* by the burring method (burring processing), and the fins 30*a* and 30*b* are assembled while the projecting portions 36 of the short fins 30*b* abut against the adjacent long fins 30*a*, whereby the interval of the fins at the upper portion 33*a* is set to the fin pitch P1. Accordingly, the fin pitch P2 between the long fins 30*a* at the lower portion 33*b* (the fin pitch under the state that no short fin 30*b* exists) can be set to a value longer than the fin pitch P1, preferably to the double of the fin pitch P1. The fin pitch P2 between the long fins 30*a* at the lower portion 33*b* is necessarily settled by assembling the fins at the upper portion 33*a*, and it is unnecessary to assembly the fins while the fin pitch P2 is secured by using an assembling jig. As a result, the number of assembling steps can be reduced.

In the above embodiment, the long fins 30*a* and the short fins 30*b* are alternately arranged (that is, each short fin 30*b* is disposed between the adjacent long fins 30*a*). However, two or more short fins 30*b* may be disposed between the adjacent long fins 30*a* to thereby settle the fin pitch P2 of the fins at the lower portion 33*b*. Accordingly, the fin pitch P2 can be secured by arranging the two or more short fins 30*b* between the adjacent long fins 30*a* on the basis of the limit of the length of the projecting portions 36 which can be formed by the burring method.

Furthermore, according to the showcase of the second construction of the embodiment of the present invention, the plural hole portions 40 are arranged on three columns 41, 42 and 43 along the flow direction of air to be cooled so that any selected adjacent three hole portions S1, S2, S3 are located at the apexes of a substantially regular (equilateral) triangle. In addition, the plural hair pins are constructed by the first hair pins 31*a* and the second hair pins 31*b*. Each of the first hair pins 31*a* has two straight pipe portions T of the U-shape whose pitch is equal to the length of one side of the regular triangle, and disposed so as to bridge the adjacent columns of the hole portions 40. Each of the second hair pins 31*b* has two straight pipe portions T of the U-shape whose pitch is equal to the double pitch of the first hair pin 31*a*, and disposed so as to bridge the columns at both the ends (i.e., excluding the center column 42 out of the three columns). Therefore, the first and second hair pins 31*a* and 31*b* can be arranged so as to bridge different columns at all times. Accordingly, as compared with the case where the hair pins are arranged on the same column, the straight pipe portions T of the plural hair pins 31*a* and 31*b* can be prevented from being densely arranged at some local positions. As a result, it makes it difficult to frost the cooler 8. Therefore, there can be provided the showcase 1 in which flow of air to be cooled can be prevented from being disturbed by frost and stable cooling performance can be implemented.

Furthermore, the plural hole portions 40 are arranged so as to form plural lines along the direction Z which intersects to the air flow direction at an angle of about 60°, and when viewed in the direction Z, the first and second hair pins 31*a* and 31*b* are secured so that the straight portions T of the U-shape of the first and second hair pins 31*a* and the second hair pins 31*b* are interspersed every other line. Therefore, the interval between the straight portions T of the first and second hair pins 31*a* and 31*b* can be secured, and the plural refrigerant pipes can be prevented from being densely arranged at some local positions. As a result, it makes it difficult to frost the cooler 8, so that there can be provided the showcase 1 in which flow of air to be cooled can be prevented from being disturbed by frost, and stable cooling performance can be implemented.

The present invention is not limited to the above embodiment, and various kinds of modifications and alterations can be made without departing from the subject matter of the present invention. For example, in the above embodiment, the compressor 14, the heat exchanger 15, etc. constituting the refrigerant circuit are provided in the showcase 1. However, the compressor 14, the heat exchanger 15, etc. may be disposed outside the showcase insofar as the cooler 8 can be disposed in the showcase 1. Accordingly, the dimension of the outer shape of the showcase 1 can be reduced, and the space can be saved. Furthermore, the above embodiment has been describing by exemplifying the combination of the first construction and the second construction, however, even when each of the first and second constructions is adopted independently of each other, the effect of making it difficult to frost the cooler (the fins, etc.) can be attained.

What is claimed is:

1. A showcase having a fin-and-tube type cooler comprising:

plural planar fins; and a refrigerant pipe penetrating through the plural planar fins to cool air fed toward display racks, wherein the plural planar fins have hole portions through which the refrigerant pipe penetrates, wherein the refrigerant pipe comprises first U-shaped hair pins, each of the first U-shaped hair pins having two straight pipe portions, and second U-shaped hair pins, each of the second U-shaped hair pins having two straight pipe portions, a pitch between the two straight pipe portions of each second U-shaped hair pin is double a pitch between the two straight pipe portions of each first U-shaped hair pin, and the first and second U-shaped hair pins penetrate through the hole portions formed in the plural planar fins, wherein the hole portions are aligned on three columns along a flow direction of air to be cooled so that any selected three adjacent hole portions constitute three apexes of a substantially regular triangle, the first U-shaped hair pins are arranged to bridge the hole portions of the adjacent two columns so that the pitch between the two straight pipe portions of each first U-shaped hair pin is equal to the length of one side of the substantially regular triangle, and the second U-shaped hair pins are arranged to bridge the hole portions of the two columns at both the ends of the cooler excluding the center column out of the three columns, wherein all of the first U-shaped hair pins and the second U-shaped hair pins are disposed in a zigzag arrangement to intersect the flow direction of the air at a predetermined angle so that each second U-shaped hair pin is disposed between adjacent first U-shaped hair pins, and one or two straight pipe portions of the first and second U-shaped hair pins are located at one or two out of the three apexes of the substantially regular triangle, wherein the plural planar fins comprise long fins arranged in parallel to the air flow direction, and short fins that are shorter in length in the air flow direction than the long fins and arranged between respective adjacent long fins only at the downstream side, with respect to the air flow direction, of a center line of the cooler, wherein the long fins are double the length of the short fins, wherein projecting portions are formed at edge portions of the hole portions, and the long and short fins are assembled so that the projecting portions thereof abut against the adjacent fins, thereby keeping the interval between the respective adjacent fins, and wherein a fin pitch of the fins at the upstream side of the cooler with respect to the air flow direction is set to double a fin pitch of the fins at the downstream side of the cooler with respect to the air flow direction.

2. The showcase according to claim 1, wherein the projecting portions are formed by subjecting the hole portions to burring processing.

3. The showcase according to claim 1, wherein all of the first U-shaped hair pins and the second U-shaped hair pins are disposed to intersect the air flow direction at an angle of about 60°, and the respective straight pipe portions of the U-shaped first and second hair pins are interspersed every other line when viewed from the direction intersecting the air flow direction.

* * * * *